US007500889B2

(12) United States Patent
Pizzi

(10) Patent No.: US 7,500,889 B2
(45) Date of Patent: Mar. 10, 2009

(54) COMBINED CABLE GUIDING/CLAMPING DEVICE

(75) Inventor: Giordano Pizzi, Milan (IT)

(73) Assignee: Nectogroup S.r.l., Altavilla Vicentina (IT)

( * ) Notice: Subject to any disclaimer, the term of this patent is extended or adjusted under 35 U.S.C. 154(b) by 0 days.

(21) Appl. No.: 11/829,316

(22) Filed: Jul. 27, 2007

(65) Prior Publication Data

US 2008/0026646 A1 Jan. 31, 2008

(30) Foreign Application Priority Data

Jul. 28, 2006 (IT) ..... MI2006A1497

(51) Int. Cl.
*H01R 11/01* (2006.01)

(52) U.S. Cl. ..... 439/783

(58) Field of Classification Search ..... 439/783, 439/790; 174/190, 153 G, 542, 543; 248/56, 248/74.1

See application file for complete search history.

(56) References Cited

U.S. PATENT DOCUMENTS

| | | | | | |
|---|---|---|---|---|---|
| 3,751,579 | A | * | 8/1973 | Nojiri | 174/153 G |
| 5,243,139 | A | * | 9/1993 | Law | 174/153 G |
| 5,276,280 | A | * | 1/1994 | Ball | 174/652 |
| 2006/0148302 | A1 | | 7/2006 | Patel et al. | 439/395 |

FOREIGN PATENT DOCUMENTS

| | | | |
|---|---|---|---|
| EP | 1 798 821 | A2 | 6/2007 |
| FR | 2 259 462 | | 8/1975 |
| FR | 2 529 024 | | 12/1983 |
| FR | 2 637 740 | | 4/1990 |
| GB | 2 342 508 | A | 4/2000 |
| IT | 0382999 | * | 8/1990 |

* cited by examiner

*Primary Examiner*—Alexander Gilman
(74) *Attorney, Agent, or Firm*—Mintz, Levin, Cohn, Ferris, Glovsky and Popeo, P.C.; David F. Crosby

(57) ABSTRACT

Combined cable guiding and clamping device comprising a support base-piece provided with guides and engagement elements for engagement with the wall of an electric apparatus (such as an appliance) and an opening suitable for the insertion of a cable, said base-piece incorporating a cable clamping device and a body for protecting the cable.

27 Claims, 2 Drawing Sheets

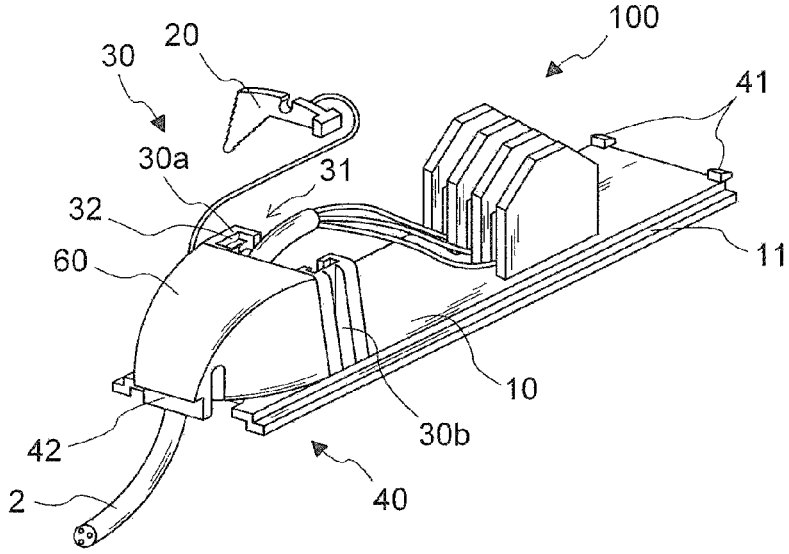
Fig.6
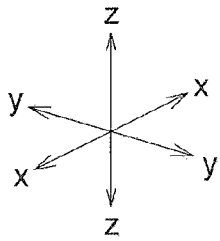
Fig.7
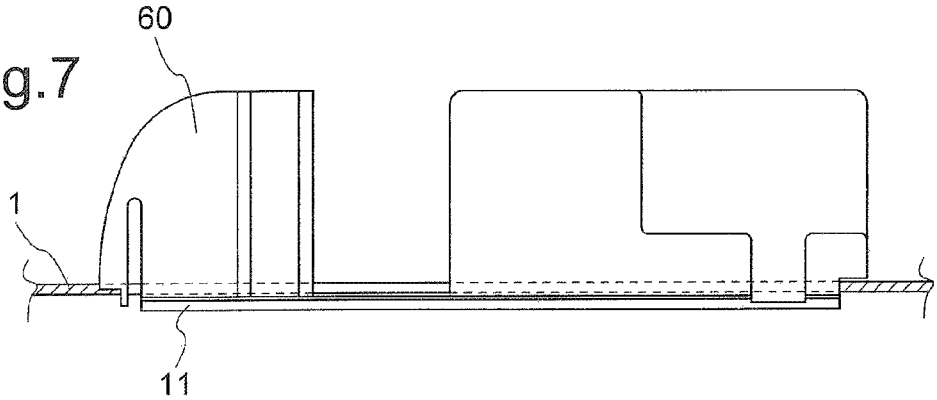
Fig.8
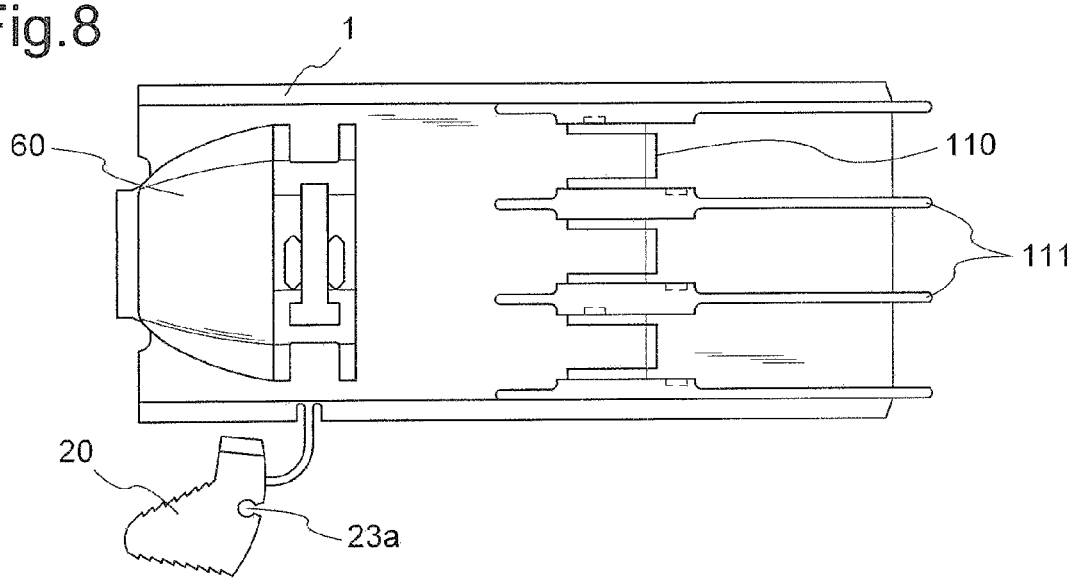

COMBINED CABLE GUIDING/CLAMPING DEVICE

BACKGROUND

1. Technical Field of the Invention

The present invention relates to a combined cable guiding/clamping device.

2. Description of the Prior Art

It is known, in the technical sector relating to electric cables, that difficulties exist as regards the need to provide preassembled wiring cables such that they have a plug or the like at one end and the terminal block to be connected to the electric household appliance or electrical apparatus at the other end.

It is known that the greatest difficulties in designing these preassembled cables arise from the need to have, at the end for connection to the electric household appliance, a part which is able to guide the cable from the outside to the inside of the closing wall of the appliance and firmly retain the cable in order to avoid separation resulting from accidental pulling forces, providing on the inside an end which can be connected, by means of a terminal block, connector or the like, to the internal wiring of the electric household appliance.

For this purpose, retaining parts, commonly called cable grips are used, said parts having a body with an external shape suitable for mating with the corresponding seat of the appliance and an axial through-hole inside which the cable is inserted and then held in position by means of a movable bridge-piece which is fixed using one or more screws screwed into the body of the cable clamping device.

Although fulfilling their function, these cable grips however have some practical drawbacks arising from the presence of the screws which, apart from forming an additional component of the assembly, with its own cost, must be subsequently fitted during production with an obvious increase in the labour costs.

IT 1,317,965 also discloses a cable guide which has a hole passed through by a transverse opening which is able to receive, inserted inside it, a wedge able to come into contact with the cable in order to retain it.

Although fulfilling its function, this cable guide has drawbacks arising from the fact that the seat for the cable consists of a hole perpendicular to the direction of extension of the cable, which does not facilitate bending of the cable so that it is able to pass through from the outside to the inside in particular in the case of large diameters.

SUMMARY

The technical problem which is posed, therefore, is that of providing a cable guiding/clamping device for the assembly of electric cables to be passed inside electric apparatus, such as electric household appliances and the like, which allows quicker, easier and cheaper production thereof and results in more stable fixing of the cable, being able to be applied in an easy, flexible and repeatable manner and having a limited thickness so as to allow application also to those apparatus such as cooking hobs which, having an intrinsic limited thickness, require, once inserted inside their seat, special features for connecting the electric cables.

In connection with this problem a further requirement is that the cable guide/clamp should allow a reduction in the overall quantity of material which is required for the manufacture thereof and should also be able to be associated, during assembly, with specific devices necessary for operation of the individual electric household appliance so as to reduce the fitting time and allow pre-wiring and testing of the various incorporated components outside of the electric household appliance.

These results are achieved according to the present invention by a combined cable guide/clamp according to the characteristic features of Claim 1.

BRIEF DESCRIPTION OF THE FIGURES

Further details may be obtained from the following description of a non-limiting example of embodiment of the subject of the present invention provided with reference to the accompanying drawings in which:

FIG. 6 shows a perspective view of a second embodiment of the cable guide according to the present invention;

FIG. 7 shows a side view of the cable guide according to FIG. 6; and

FIG. 8 shows a top plan view of the cable guide according to FIG. 6.

DETAILED DESCRIPTION OF PREFERRED EMBODIMENTS

Figure 1:
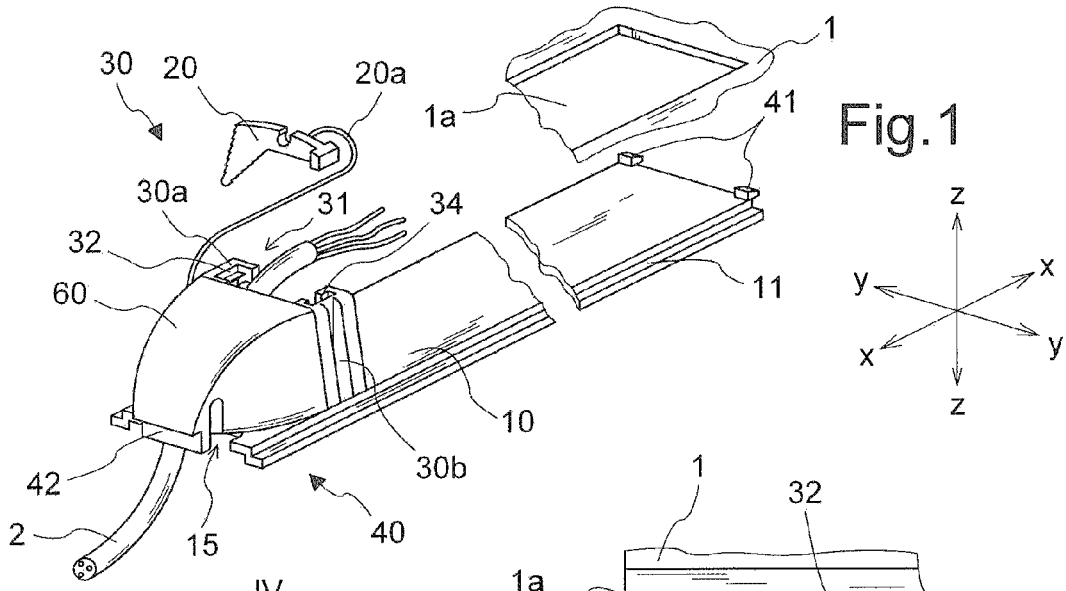
FIG. 1 shows a perspective view of a cable guide/clamp according to the present invention.
Figure 3:
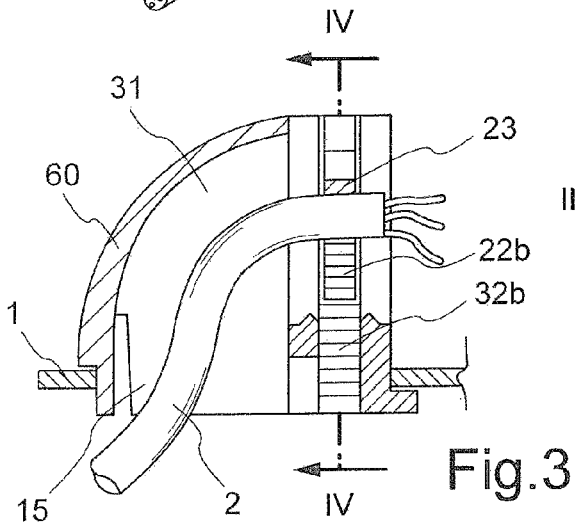
FIG. 3 shows a cross-section along the plane indicated by the line III-II in FIG. 2.
Figure 2:
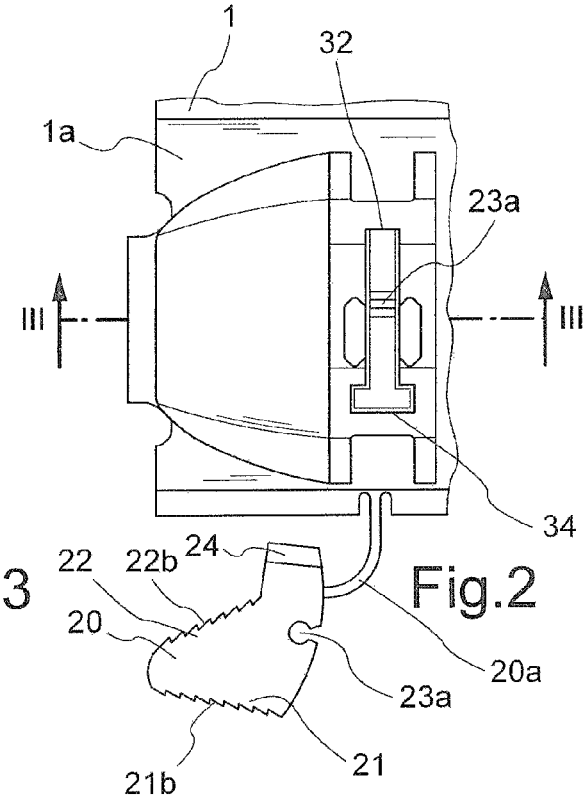
FIG. 2 shows a view, from above and from the inside of the electric household appliance, of the cable guide/clamp according to FIG. 1.

As shown in FIG. 1 and with reference to a set of three reference axes assumed solely for the sake of convenience of the description, i.e. longitudinal axis X-X, transverse axis Y-Y and vertical axis Z-Z, in relation to the orientation layout in the figures, the cable guiding/clamping device according to the present invention comprises essentially a base-piece 10 extending in a longitudinal direction X-X over a length slightly smaller than the corresponding dimension of the opening 1*a* in an electric household appliance, schematically indicated with its wall 1; said base-piece has longitudinal sides which are formed with transverse undercuts or guides 11 extending longitudinally and able to form a front contact edge for applying the cable guide/clamp to said wall 1.

At one of the two opposite longitudinal ends, the cable guide/clamp has two teeth 41 projecting outwards and able to form the part of the engagement elements 40 which also comprise a lug 42 resiliently deformable in the longitudinal direction and arranged at the opposite end of the base-piece.

In a preferred embodiment, said lug 42 is integral with a convex body 60, incorporated in the base-piece 10, for protecting an opening 15 suitable for the insertion of a cable 2 so as to allow it to pass through, in the transverse direction, from the outside to the inside and the introduction into a cable clamping device 30 integral with the base-piece 10. As shown in FIGS. 2, 3, 4 and 5, the cable clamp 30 comprises a body which has a seat 31 which is open on the opposite side to the base-piece 10, resulting in a substantially U-shaped overall form of the cable clamp, able to allow the insertion, in the vertical and transverse direction, of the cable 2 extending in the longitudinal direction X-X.

Figure 4:
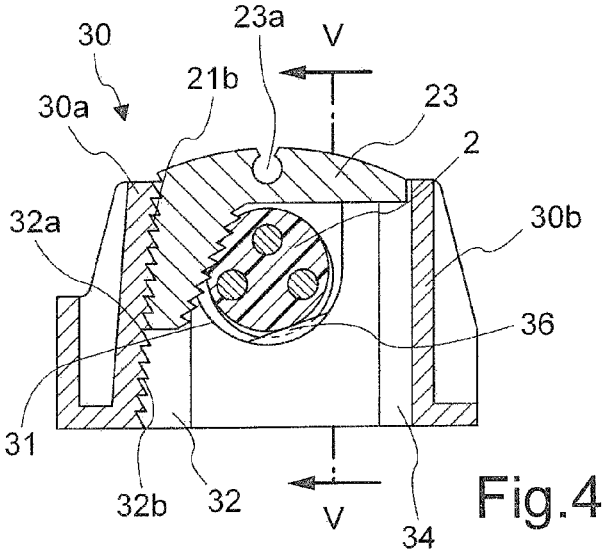
FIG. 4 shows a cross-section along the plane indicated by the line IV-IV in FIG. 3.

One of the two uprights of the "U", i.e. 30*a* in example shown in the FIG. 4, has in turn a seat 32 which extends vertically and is open towards the seat 31 housing the cable 2 and the end surface 32*a* of which has sawtooth profile 32*b*.

The other upright 30*b* of the "U" has a seat 34 in turn extending in the vertical direction, open only at the top and having a cross-section preferably in the form of a "T".

Figure 5:
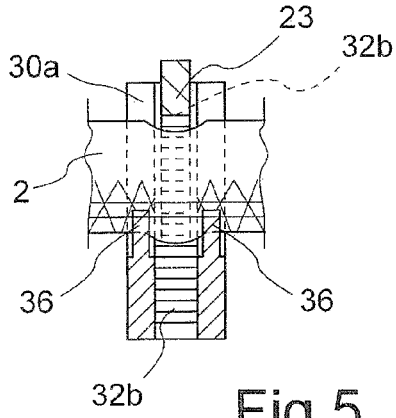
FIG. 5 shows a cross-section along the plane indicated by the line V-V in FIG. 4.

According to a preferred embodiment of the cable clamp and as shown in FIG. 5, the bottom of the "U" is also provided with two ribs 36 which are able to react with the cable 2 as will be explained below.

The body 30 of the cable clamp has fastened to it, by means of a thin cord 20*a*, a wedge-shaped part 20 which has a side 21, on the outside with respect to the position of the cable 2, which is inclined and has a sawtooth profile 21*b* corresponding to the sawtooth profile 32*b* of the seat 32.

The inner side 22 of the wedge has in turn a sawtooth profile 22*b* suitable for engagement with the cable 2 as will emerge more clearly below.

In a preferred embodiment the wedge 20 has a head 23 in which a recessed seat 23*a* is formed for operation by means of a manual tool.

The head 23 is extended laterally by a T-shaped extension 24 which is suitable for insertion inside the corresponding seat 34 of the upright of the "U", inside which it is able to slide in the vertical direction Z-Z, preventing, however, the movement of the wedge at least in the transverse direction Y-Y and/or in the longitudinal direction Y-Y.

With the configuration described above, operation of the cable guide/clamp is as follows:

the cable 2 is introduced into the seat 31, causing it to pass through the opening 15 and the protective body 60;

the wedge 20 is introduced into the said seat, causing the head 24 to enter into the corresponding guide seat 34;

as a result the sawtooth profile 21*b* of the outer side 21 come into contact with the corresponding sawtooth profile 32*b* of the vertical seat 32; and the sawteeth 22*b* come into contact with the cable 2.

A subsequent force can be applied in the vertical direction on the head 23 of the wedge 20 and can have the following effects:

deformation of the cable 2 which assumes a position along a corresponding longitudinal section inside a seat formed by the said ribs 36 projecting inside the seat 31;

a reaction of the cable 2 which pushes the wedge 20 against the wall 32 of the upright 30*a* so that the respective teeth 32*b* and 21*b* engage together causing locking of the wedge;

reaction of the head 24 inside the vertical seat 34 which prevents the rotation of the wedge, keeping it aligned and preventing sticking thereof which would prevent any subsequent further operations, such as, for example, extraction of the wedge, this being possible by inserting a tool inside the seat 23*a* of the head and suitably operating it so as to move the wedge towards the axis Y-Y until disengagement of the teeth 32*b*,21*b* and therefore extraction of the wedge occurs; and by performing only a slight outward movement of the wedge it is also possible to free the cable for displacement thereof in the longitudinal direction, without the need for complete extraction of the wedge;

Once the cable clamp has been prepared with the associated cable gripped in position, it will be possible to insert the teeth 41 inside the opening 1*a;* resulting in contact of the transverse undercuts 11 of the longitudinal sides of the base-piece 10;

and, by pressing the lug 42 of the body 60, obtain engagement of the resilient lug 42 with the wall 1 of the electric household appliance.

As shown in FIG. 6, the cable guide/clamp according to the present invention may be formed by incorporating an auxiliary device 100 necessary for the specific application.

Only by way of example FIGS. 6 to 8 illustrate a cable guide/clamp in which this auxiliary device consists of a fast-on terminal strip 110 separated by partitions 111; it is envisaged, however, that the auxiliary device may consist of a noise-suppression filter, a piezoelectric igniter, safety shut-off valves for gas flames and the like (not shown) and/or combinations of these devices.

Although not shown, it is also envisaged that the wedge of the cable clamp has a symmetrical structure with two outer sides having a respective sawtooth profile; in this configuration the body 10 has an upright 30*b*, opposite the second outer side, with a sawtooth profile corresponding to the second sawtooth profile of the symmetrical wedge and the head of the wedge is symmetrical and has an internal resilient hinge.

It is envisaged, moreover, that the inner sides of the wedge designed to make contact with the cable have a surface which is inclined with respect to the longitudinal direction so as to form an edge able to interact with the cable 2.

All the advantages of the cable guide/clamp according to the invention compared to the prior art clearly emerge from the description given above: with the cable guide/clamp it is in fact possible to reduce the overall dimensions of the unit which may consequently also be inserted in seats with a limited rear space.

In addition to this, the engagement between the two sets of teeth of the cable clamp is substantially unaffected by vibrations, this resulting in more stable and lasting gripping of the cable.

The device according to the invention, in addition to facilitating insertion of the cable, may also form the base for supporting the various components necessary for operation of the electric household appliance, allowing the elimination of or reduction in the number of internal wires and operation using simple or a reduced number of connection components of the entire sub-unit already assembled and tested at the time of installation.

The invention claimed is:

1. A combined cable guiding/clamping device comprising:

a support base-piece provided with a guide and engagement elements for fastening the support base-piece to an opening in a wall of an electrical apparatus and an opening suitable for the insertion of a cable, the base-piece including a cable clamping device and a body for protecting the cable, wherein said base-piece extends in a longitudinal direction over a length slightly less than the corresponding dimension of the opening in the wall of an electric household appliance, wherein said base-piece has longitudinal sides formed with transverse undercuts extending longitudinally and able to form a front contact edge for applying the cable guiding/clamping device against the wall of the electrical apparatus, and wherein the cable is oriented substantially perpendicular to the base-piece upon entry into the device and extents substantially parallel to the said base-piece through the cable clamping device.

2. The device according to claim 1, wherein the inner sides of the wedge that make contact with the cable have a surface which is inclined with respect to a longitudinal direction so as to form an edge able to interact with the cable.

3. The device according to claim 1, wherein the engagement elements include two teeth projecting outwards from one of two opposite longitudinal ends of the base-piece.

4. The device according to claim 3, wherein the engagement elements include a lug which is resiliently deformable in the longitudinal direction and arranged at the end of the base-piece opposite to that of the teeth.

5. The device according to claim 4, wherein the lug is integral with the body for protecting the cable.

6. The device according to claim 1, wherein the base-piece supports an auxiliary device integral with an internal surface thereof.

7. The device according to claim 6, wherein the auxiliary device can be connected to the cable.

8. The device according to claim 6, wherein the auxiliary device comprises at least one pre-wired terminal block.

9. The device according to claim 6, wherein the auxiliary device comprises at least one piezoelectric igniter.

10. The device according to claim 6, wherein the auxiliary device comprises at least one noise-suppression filter.

11. The device according to claim 6, wherein the auxiliary device comprises at least one gas shut-off valve.

12. The device according to claim 1, wherein the cable clamping device has a seat for containing a cable, said seat having at least one side provided with a vertical guide seat, a surface of which is provided with teeth suitable for engagement with corresponding teeth of a wedge-shaped part, the cable clamping device having a second vertical seat with a suitable cross-section able to co-operate with an associated head extension of the wedge-shaped part with a corresponding cross-section for producing a reaction to the forces exerted on the wedge in a transverse direction.

13. The device according to claim 12, wherein the seat is open in a vertical direction.

14. The device according to claim 12, wherein the bottom of the seat is provided with two ribs that define a partition and engage the cable.

15. The device according to claim 12, wherein the wedge-shaped part is fastened to the body by a thin cord.

16. The device according to claim 12, wherein the wedge-shaped part has an asymmetrical structure and includes at least one side, on the outside with respect to the position of the cable, which is inclined and has a sawtooth profile corresponding to a sawtooth profile of the seat.

17. The device according to claim 12, wherein the wedge-shaped part has at least one inner side which is inclined and has a sawtooth profile adapted to engage with the cable.

18. The device according to claim 17, wherein the inner side has an inclination different from that of the outer side.

19. The device according to claim 12, wherein the seat has an opening in the side opposite to the transverse base portion.

20. The device according to claim 19, wherein the seat has a substantially U-shaped overall form.

21. The device according to claim 12, wherein the wedge-shaped part has a symmetrical structure with two outer sides having a respective sawtooth profile.

22. The device according to claim 21, wherein the cable clamp device has an upright portion facing a second outer side, with a sawtooth profile corresponding to a second sawtooth profile of the symmetrical wedge.

23. The device according to claim 12, wherein the cable clamping device has two upright portions connected by a transverse base portion.

24. The device according to claim 23, wherein at least one of the two upright portions has a seat in turn extending in the vertical direction, open only at the top and with a T-shaped cross-section.

25. The device according to claim 23, wherein at least one of the two upright portions has a seat extending in vertical direction and said seat extending in vertical direction being open towards the seat housing the cable.

26. The device according to claim 25, wherein the head of the wedge has an internal resilient hinge.

27. The device according to claim 12, wherein the inner sides of the wedge that make contact with the cable have a smooth surface.

* * * * *